US009238291B2

(12) United States Patent
Toncelli

(10) Patent No.: US 9,238,291 B2
(45) Date of Patent: Jan. 19, 2016

(54) MACHINE FOR SMOOTHING OR POLISHING SLABS OF STONE MATERIALS, SUCH AS NATURAL AND AGGOLOMERATED STONE, CERAMIC AND GLASS

(76) Inventor: Luca Toncelli, Bassano del Grappa (IT)

( * ) Notice: Subject to any disclaimer, the term of this patent is extended or adjusted under 35 U.S.C. 154(b) by 684 days.

(21) Appl. No.: 13/643,908

(22) PCT Filed: Nov. 22, 2010

(86) PCT No.: PCT/IB2010/055321

§ 371 (c)(1),
(2), (4) Date: Oct. 26, 2012

(87) PCT Pub. No.: WO2011/064706

PCT Pub. Date: Jun. 3, 2011

(65) Prior Publication Data

US 2013/0137346 A1 May 30, 2013

(30) Foreign Application Priority Data

Nov. 25, 2009 (IT) ..... TV2009A0224

(51) Int. Cl.
*B24B 7/22* (2006.01)
*B24B 7/06* (2006.01)
*B24B 41/047* (2006.01)

(52) U.S. Cl.
CPC ... *B24B 7/22* (2013.01); *B24B 7/06* (2013.01); *B24B 41/0475* (2013.01)

(58) Field of Classification Search
CPC ..... B24B 7/06; B24B 7/22; B24B 7/224; B24B 41/475; B24B 47/22
USPC ..... 451/11, 41, 119, 121, 131, 132, 135, 451/150, 260
See application file for complete search history.

(56) References Cited

U.S. PATENT DOCUMENTS 2,735,238 A * 2/1956 Heffley ..... 451/260
4,914,870 A 4/1990 Toncelli (Continued)

FOREIGN PATENT DOCUMENTS

CN 201109058 Y 9/2008
CN 101327568 A 12/2008
DE 3826655 A1 3/1989

(Continued)

OTHER PUBLICATIONS

PCT International Search Report and Written Opinion dated Feb. 10, 2011 for PCT/IB2010/055321, from which the instant application is based, 7 pgs.

*Primary Examiner* — Monica Carter
*Assistant Examiner* — Lauren Beronja
(74) *Attorney, Agent, or Firm* — Fredrikson & Byron, P.A.

(57) ABSTRACT

A machine for smoothing or polishing slabs of stone material, such as natural and agglomerated stone, ceramic and glass, comprises a longitudinal bench (12) over which the slabs to be machined move, at least one pair of opposite bridge support structures (20, 22) arranged astride the bench, and at least one beam (24) transversally movable and supported by said bridge structures. At least one vertical-axis and vertically movable mandrel (40) is mounted eccentrically on a mandrel supporting structure (30) which rotates about its vertical axis (Z1) and is supported on said beam (24). The mandrel has, mounted on its bottom end, a device carrying the smoothing or polishing tools and rotating about the axis of rotation of said mandrel. In this way, the tool carrying device performs a movement composed of the rotation about the axis of rotation of the mandrel, a revolving movement about the axis of rotation of the mandrel carrying structure and a translation movement due to the movement of the beam.

17 Claims, 11 Drawing Sheets

(56) References Cited

U.S. PATENT DOCUMENTS

| | | | | |
|---|---|---|---|---|
| 6,645,043 | B1 * | 11/2003 | Yenawine | 451/5 |
| 7,351,130 | B1 * | 4/2008 | Chang | 451/11 |
| 7,632,171 | B2 * | 12/2009 | Heesemann | 451/66 |
| 2003/0092359 | A1 | 5/2003 | Pedrini | |
| 2007/0099546 | A1 * | 5/2007 | Jespersen | 451/11 |

FOREIGN PATENT DOCUMENTS

| | | | |
|---|---|---|---|
| DE | 20108708 | U1 * | 7/2001 |
| EP | 0879677 | A2 | 11/1998 |
| WO | 0168320 | A1 | 9/2001 |
| WO | WO 0168320 | A1 * | 9/2001 |
| WO | 2006000542 | A1 | 1/2006 |

* cited by examiner

MACHINE FOR SMOOTHING OR POLISHING SLABS OF STONE MATERIALS, SUCH AS NATURAL AND AGGOLOMERATED STONE, CERAMIC AND GLASS

RELATED APPLICATIONS

This application is a 35 U.S.C. 371 national stage filing from International Application No. PCT/IB2010/055321 filed Nov. 22, 2010, and claims priority to Italian Application No. TV2009A000224 filed Nov. 25, 2009, the teachings of which are incorporated herein by reference.

FIELD OF THE INVENTION

The present invention relates to a machine for smoothing or polishing slabs of stone material, such as natural and agglomerated stone, ceramic and glass.

BACKGROUND

These machines usually comprise a longitudinal bench over which a belt for moving the slabs to be smoothed or polished travels, two bridge support structures arranged astride the belt, one on the entry side for the material to be machined and the other one of the exit side for the machined material.

A mandrel carrying beam is supported at its opposite ends by two bridge structures. The beam is fitted with a series of vertical-axis smoothing and/or polishing mandrels which are arranged in a row and have, mounted on their bottom ends, supports which rotate about the vertical axis of the mandrel and are in turn fitted with abrasive tools, as will be explained more clearly below.

The beam may be fixed in position, if the working area of the smoothing or polishing mandrels is able to cover the entire width of the slabs to be smoothed/polished.

As occurs most frequently, however, since the slabs to be machined are very wide, the beam is slidably supported on the two bridge structures so as to perform an alternating rectilinear movement transverse to the direction of feeding of the material so that the working area of the tool carrying mandrels is able to cover the entire width of the slabs. The degree of translation varies depending on the width of the material being machined.

The tools used are made of hard granular materials, for example normally silicon carbide or diamond. In industrial applications the abrasive granules usually are not used in loose form, but are bonded together to form an abrasive tool by means of a bonding matrix (which may be a cement, a resin, a ceramic or a metal), this having the function of retaining the granules for as long as they are able to be perform their abrasive action, before eventually flaking and releasing the granules once worn.

The abrasive tools, as mentioned above, are normally fixed to a support which is rotationally driven by a vertical-axis mandrel.

In the case of soft stone materials, such as marble, the support for the tools, which have a prismatic form with flat surfaces, is generally an abrasive carrying plate.

In the case of hard stone materials, instead, such as granite or quartz, the support is usually a head which imparts a specific movement to the tools which are differently shaped and in any case in a spoke-like arrangement. The head may be of the type with oscillating supports (so-called oscillating-segment head) or rotating supports which have a substantially horizontal axis for roller-shaped tools (so-called roller head) or rotating supports with a substantially vertical axis for flat tools (so-called flat-disc head or also planetary or orbital head).

The tools also have a grain size which gradually decreases (from a few hundreds of micrometers to a few micrometers) as the slab passes underneath them. In particular, the first mandrel which machines the slab to be smoothed has tools with a relatively large grain size, the second mandrel has tools with a grain size which is slightly smaller and so on, while the tools with a very fine abrasive grain are mounted on the last mandrel.

The mandrel is slidable vertically and imparts to the tools resting on the surface of the material a pressure which may be of a mechanical, hydraulic or pneumatic nature; pneumatic pressure is by far preferred and this case the mandrel, or so-called "plunger", is slidable vertically, being operated by a pneumatic pressure.

In this way a slab with a good polished finish is obtained. A number of drawbacks, however, exist.

In fact the mandrel carrying beam, and the mandrels associated with it, performs an alternating rectilinear movement transversely to the direction of feeding of the material and therefore, when the movement is reversed, there is a momentary pause in the movement of the mandrels and therefore of the smoothing or polishing tools. This pause produces a very slight local depression in the material which is sufficient, however, to create shaded zones above all on the polished surface of particularly delicate dark materials.

In an attempt to attenuate this effect, other machines have been devised where the mandrels are installed on rotating cross-like supports so as to cover the entire width of the slab to be machined. In particular, the mandrels can be positioned along the arms of the cross-pieces so as to be able to smooth and polish slabs of variable width.

Although this solution has been devised precisely in order to overcome the abovementioned problem of shaded zones, it has been noted, however, that in these machines the mandrels mounted on the cross-piece perform repetitive strokes with a coverage, or more specifically, stay time in the various zones of the material which is not uniform. This fact results in the creation, on the surface of the material, of bands with a varied polishing effect visible also to the naked eye.

BRIEF SUMMARY OF EMBODIMENTS OF THE INVENTION

The general preset object of this invention is to overcome the problems of the prior art, providing slabs which are always uniformly polished without shaded zones, even in the case of dark and delicate materials, such that these shaded zones are not visible to the naked eye.

In view of this object, according to the invention it has been thought to provide a machine for smoothing or polishing slabs of stone material, such as natural and agglomerated stone, ceramic and glass, comprising a bench for supporting the slabs to be machined, there being provided above the bench at least one machining station comprising at least one pair of opposite bridge support structures transversely arranged astride the bench, at least one beam, the two ends of which are supported by said bridge structures, at least one rotating mandrel with a sliding vertical axis, mounted on said at least one beam, at the bottom end of the mandrel there being provided at least one tool carrying support rotating about the axis of rotation of said mandrel and carrying at least one abrasive tool, characterized in that said at least one beam is transversely movable on said bridge structures so as to be moved alternately back and forth in the transverse direction; in that means for relative movement in the longitudinal direction between station and slabs on the bench are provided; in that at least one mandrel carrying structure, rotating about a vertical axis of rotation, is mounted on said beam; and in that said at least one vertically sliding mandrel is mounted on said mandrel carrying structure in an eccentric position with respect to the axis of rotation of said mandrel carrying structure, so that said tool carrying support performs at least a movement composed of the rotation about the axis of rotation of the mandrel, a revolving movement about the axis of rotation of the mandrel carrying structure and a translation movement due to the movement of the beam.

Owing to this complex movement which the smoothing and polishing tools perform, the stay time in the various working areas of the slab is very uniform. Basically, there are no zones or areas of the slab to be smoothed where the tools pause for a longer period of time. This has the result that the smoothing/polishing is performed in the most regular and uniform manner possible.

It should also be noted that the relative movement between tools and material is due to:

1. a rotational movement about the vertical axis of the mandrel on which the smoothing tool or head is mounted;
2. a revolving movement about the axis of rotation of the mandrel carrying structure;
3. a transverse, alternating, translation movement due to the movement of the beam;
4. a longitudinal translation movement due to feeding of the material on the bench and
5. an oscillation of the tool about a rotating axis, in the case of a smoothing head with oscillating shoes or, in the case of a flat-disc head, a rotation of the tool about its vertical axis or, in the case of a roller head, a rotation of the tool about its horizontal axis.

Owing to this multiple combination of such varied relative movements of tool and material it is possible to eliminate any visual defects. In fact, considering that any tool leaves machining marks, in this way, owing to the multiplicity of movements, marks which are interwoven in a particularly complex and disorderly manner are made such as to deceive the human eye which therefore does not view them as such. This fact, together with the uniform presence of the machining tools in all the zones of the slab, allows any defect resulting from the residual marks of the abrasive machining operations to be eliminated from a visual point of view.

Owing to these two particularly advantageous aspects of the invention, slabs of finished material devoid of grooves and without any visible defects are obtained, even in the case of darks slabs which are viewed against the light.

In particular, the mandrel support structure supports at least two smoothing or polishing mandrels which are arranged eccentrically with respect to the axis of rotation of the mandrel carrying structure and are preferably equidistant circumferentially.

Preferably, the machine comprises at least two mandrel carrying structures and the grain size of the abrasive grains of the tools mounted on the mandrel carrying structure situated on the material entry side is greater than the grain size of the abrasive grains of the tools mounted on the mandrel carrying structure situated on the exit side for the machined material.

In this way by increasing the number of mandrels mounted on the mandrel carrying structure and the number of mandrel carrying structures it is possible to obtain a finished slab which is optimum from an aesthetic point of view and devoid of any surface defects.

BRIEF DESCRIPTIONS OF DRAWINGS

These and further advantages of the invention will emerge more clearly from the following description, provided with reference to the accompanying drawings, of a number of embodiments thereof which apply the principles of the invention, by way of a non-limiting example. In the drawings.

DETAILED DESCRIPTION OF EMBODIMENTS OF THE INVENTION

Figure 1:
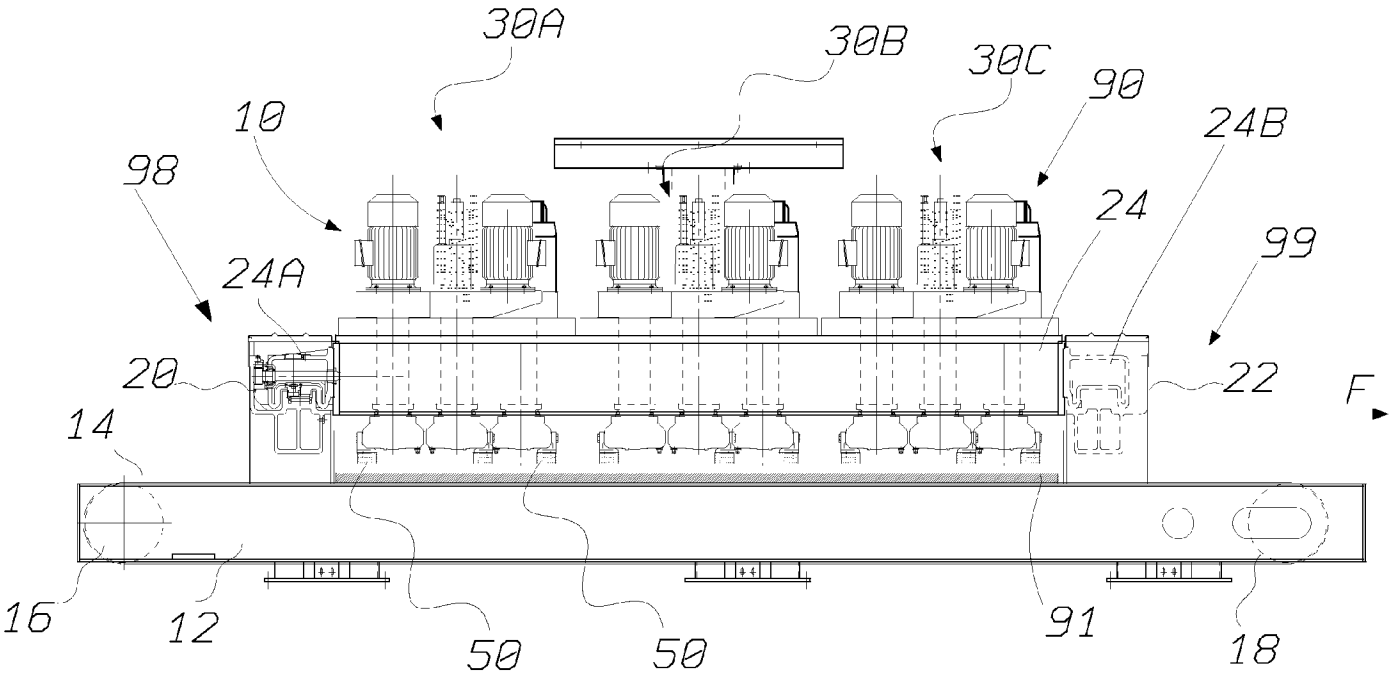
FIG. 1 is a schematic front view of a smoothing and polishing machine according to the invention.

In FIGS. 1, 2 and 3, 10 denotes in its entirety a machine for smoothing and polishing slabs of stone material, such as natural and agglomerated stone, ceramic or glass, constructed in accordance with the invention.

The machine 10 comprises a machining station 90 which is arranged above a surface or bench 12 supporting a slab to be machined 91. The station 90 comprises, in particular, two bridge support structures 20,22 which are arranged transversely astride the slab support surface. More precisely, the bridge structure 20 is positioned on the entry side for the material to be machined and the bridge structure 22 is positioned on the exit side for the machined material. "Entry side" and "exit side" are understood as referring to the relative direction of movement of slab and station, as will become clear below.

Figure 2:
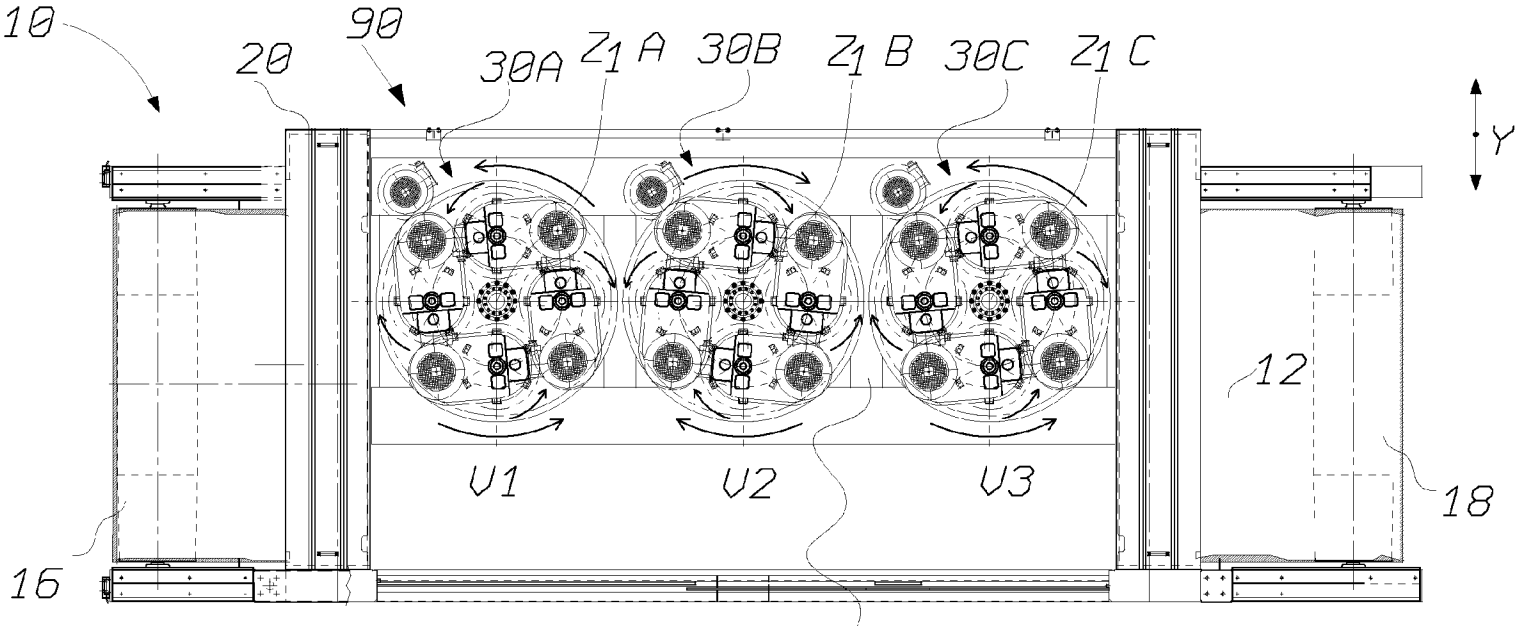
FIGS. 2 and 3 are schematic views, from above and from the side, respectively, of the machine according to FIG. 1.
Figure 3:
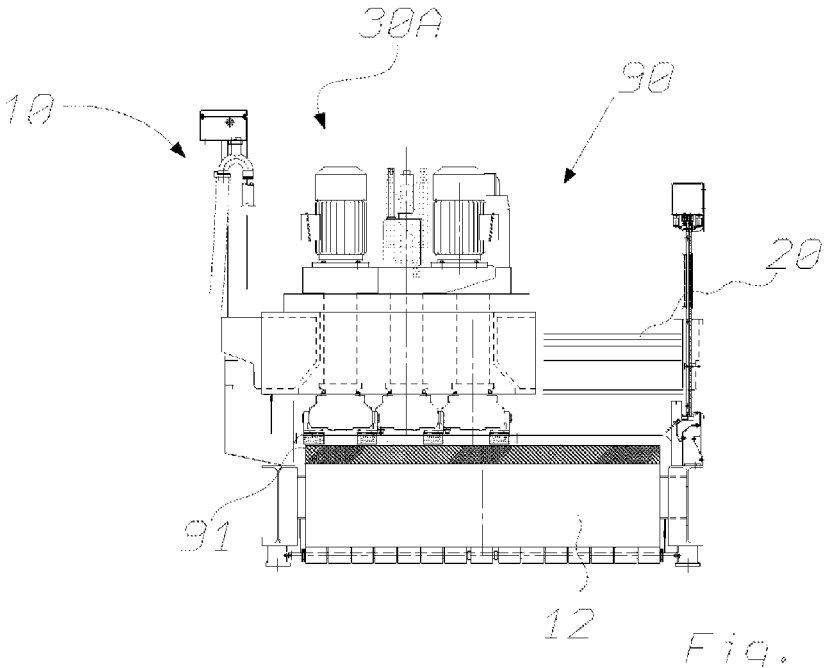
Figure 5:
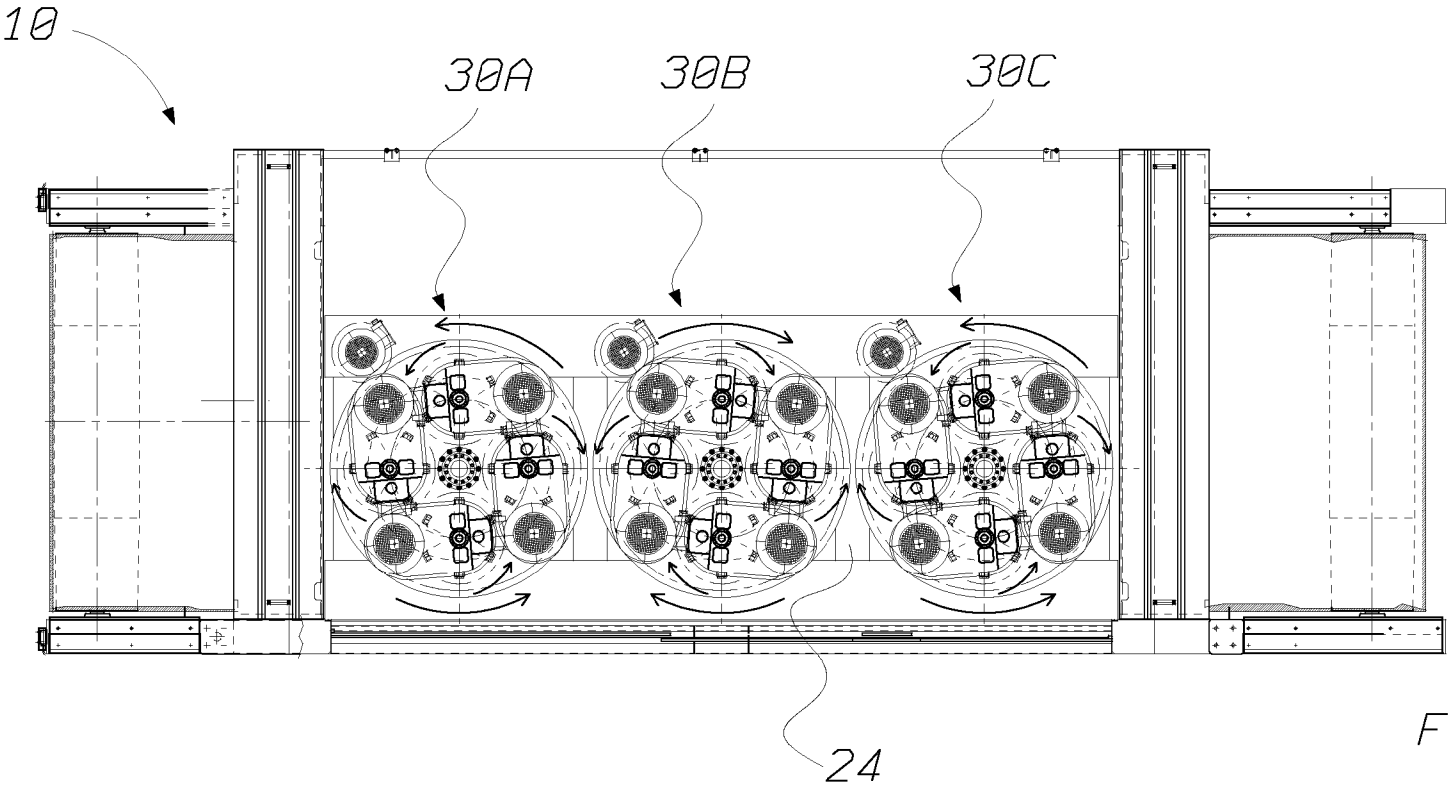
FIG. 5 shows a view, similar to that of FIG. 2, but with the movable mandrel carrying beam which is shown in a final position of its transverse stroke opposite to that shown in FIG. 2.

The two bridge structures 20, 22 support a mandrel carrying beam 24 which is therefore arranged in the direction longitudinal with respect to the direction of relative movement of slab and station. The mandrel carrying beam 24 has two ends 24*a*,24*b* which are slidably supported on the respective bridge structures 20,22 so that the beam 24 is movable in the transverse direction Y. The beam 24 is moved along the two bridge structures with an alternating rectilinear movement by means of a drive system, which is not shown in the figures, but can be easily imagined by the person skilled in the art. FIGS. 2 and 5 show the two end positions of the mandrel support beam 24 during its transverse stroke. Generally reversal of the movement occurs in these end positions. Obviously, depending on the width of the slab being machined, reversal could also take place before reaching these end positions. The maximum width of the slabs is determined by the transverse machining space available underneath the station.

In a longitudinal direction of the beam 24, the surface to be machined performs, owing to motor-driven movement means, a relative translatory movement with respect to the station 90 situated above. In the preferred embodiment shown in the figures, it is the slab which is moved underneath the station which remains stationary. For this purpose, the movement means comprise a belt 14 travelling over the longitudinal bench 12 for moving the slabs to be polished or smoothed. The belt 14 at the two ends of the bench 12 is wound around an idle roller 16 and a driving roller 18. The direction of movement of the material is for example that indicated by the arrow F. There is therefore an entry side 98 for the slabs to be machined and an exit side 99 for the machined slabs.

It is thus possible to perform continuous sequential feeding of the slabs, as can be easily imagined by the person skilled in the art. In this way, the maximum length of the slabs may have any value.

The station 90 may in any case also be designed so as to travel along the surface in the longitudinal direction, with the movement means being designed with a suitable motor-driven carriage.

Figure 6:
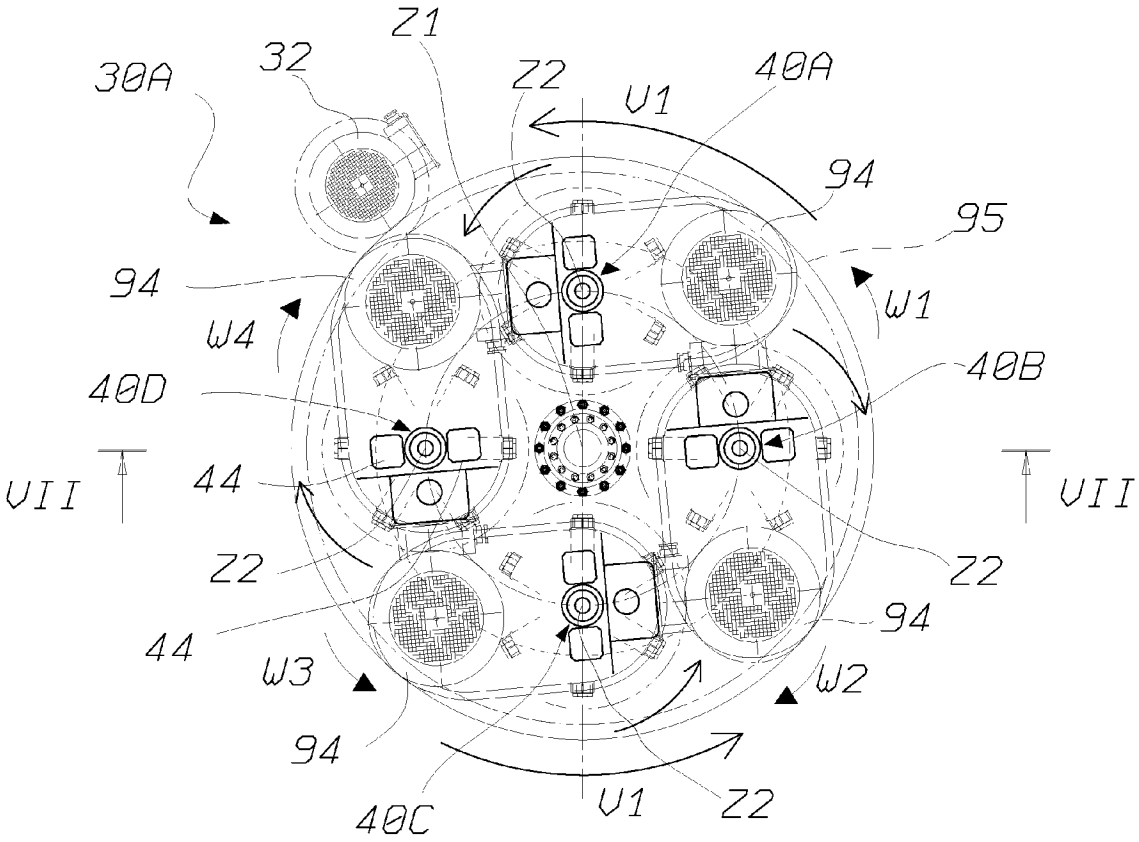
FIG. 6 is a schematic top plan view of one of the mandrel carrying structures of the machine according to FIG. 1.
Figure 7:
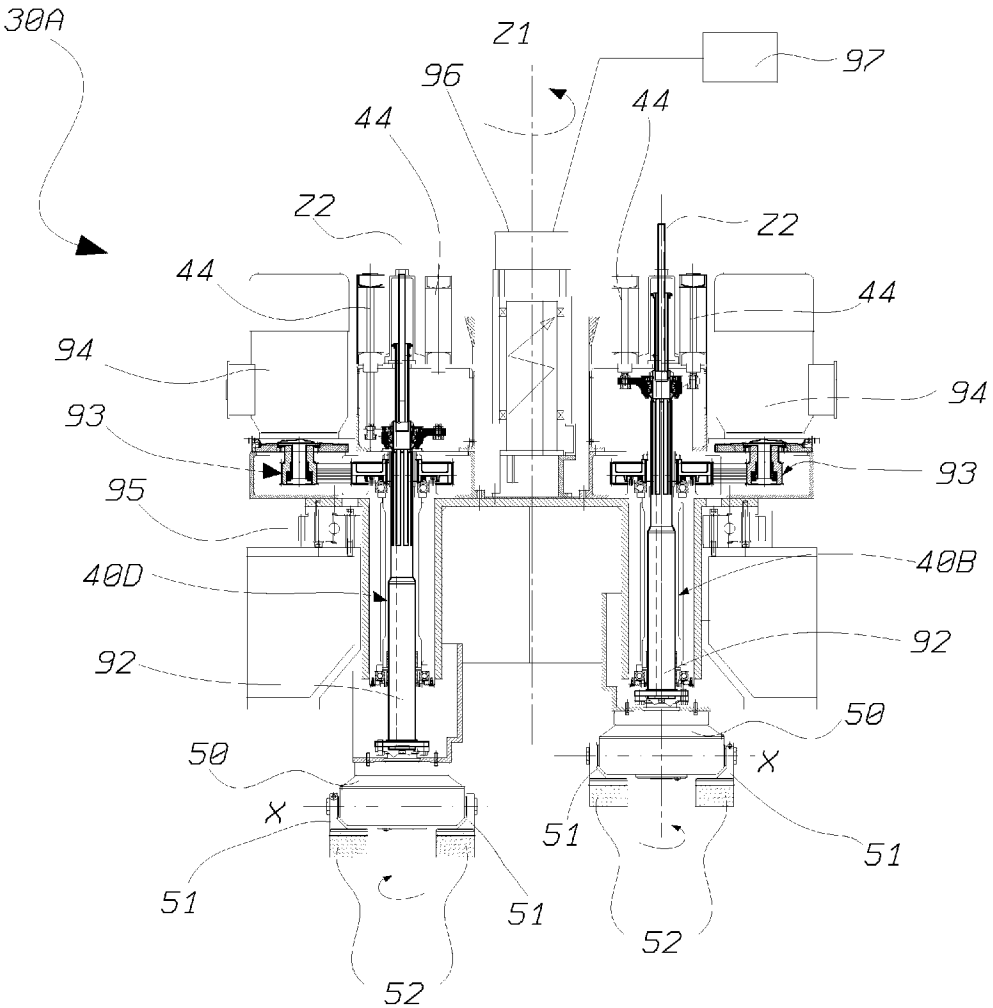
FIG. 7 is a schematic side view of a mandrel carrying structure, partially sectioned along the line VII-VII of FIG. 6.

Three machining units or mandrel carrying structures 30A, 30B,30C, which are shown more clearly in FIGS. 6 and 7, are mounted on the movable beam 24 rotatably about respective vertical axes $Z_1$ A, $Z_1$ B, $Z_1$ C. Each mandrel carrying structure 30 is provided with a motor 32 (see FIG. 6) which causes rotation of the mandrel carrying structure 30 about the vertical axis $Z_1$, advantageously meshing with a peripheral, toothed, circular rim 95. It should be noted that the three mandrel carrying structures 30A,30B,30C rotate in directions of rotation, denoted by $V_1$, $V_2$, $V_3$, respectively, which preferably alternate with each other for the reason which will be illustrated below.

Each mandrel carrying structure 30 is provided with 4 motor-driven mandrels 40A,40B,40C,40D having vertical axes $Z_2$, intended to support smoothing or polishing tools. The mandrels are preferably arranged spaced apart at the same distance relative to the axis of rotation $Z_1$ of the mandrel carrying structure 30 and are therefore positioned eccentrically with respect to the axis $Z_1$.

The bottom end of each mandrel 40A,B,C,D is fitted with a tool carrying support consisting of a machining head with abrasive tools which have machining surfaces facing the surface of the slab to be smoothed. The tool holders and the tools may have different configurations. In particular, in the embodiment shown in FIGS. 1-7, the tool carrying support consists of a smoothing head 50 of the known type with oscillating shoes (or segments), rotating about the axis $Z_2$ of rotation of the mandrel.

The oscillating-shoe smoothing head 50 is advantageously used for smoothing and polishing hard materials, such as granite or quartz, and (as can be seen more clearly in FIG. 7) comprises shoes 51 which are arranged radially and each oscillating about its radial horizontal axis X. A suitable abrasive tool 52 for smoothing or polishing the slabs is mounted on each shoe 51.

The shoes may be, for example, six in number and equidistant along the circumference around the mandrel axis.

From FIG. 6 it can be seen that the four mandrels 40A,B, C,D impart to the smoothing head 50 rotational movements which are preferably not all in the same direction and, in particular, with directions of rotation which alternate along the circumference around the central axis Z1. In the case of pairs of mandrels arranged along diameters of this circumference (as in the case shown in FIG. 6), the oppositely arranged mandrels 40A,40C impart a first direction of rotation (for example in an anti-clockwise direction) to the smoothing head, indicated by the arrows W1 and W3, while the opposite mandrels 40B,40D of the other pair impart an opposite direction of rotation (for example in a clockwise direction) to the smoothing head, indicated by the arrows W2 and W4, respectively. The reason for these rotations of the smoothing heads 50, preferably in opposite directions to each other, is clarified below.

Advantageously, the abrasive tools mounted on the smoothing heads of the same mandrel carrying structure 30 have a grain size which is the same or very similar, but the grain size of the tools varies with variation of the mandrel carrying structure on which they are mounted. In fact, in a preferred embodiment the abrasive tools mounted on the mandrel carrying structure 30A which processes first of all the material to be smoothed or polished have a grain size which is relatively large, while the mandrel carrying structures which are arranged in succession in the direction of feeding of the material use abrasive tools with an increasingly finer grain size and the last mandrel carrying structure 30C has tools with the finest grain size.

In this way, the degree of finish provided by the smoothing and polishing operations increases as the slab of material passes underneath the various mandrel carrying structures 30.

Each mandrel 40 is of the "plunger" type, i.e. is movable vertically with respect to the mandrel carrying structure 30. The movement is generated by actuators 44 which are advantageously pneumatic cylinders. It is thus possible to raise the smoothing head 50 so as to disengage it from the material to be machined, or lower it so that the abrasive tools 52 are pressed against the slab with a suitable pressure so as to able to smooth or polish the material. In FIG. 7, the left-hand mandrel is shown in the completely lowered position, while the right-hand mandrel is shown in the completely raised position.

FIG. 1 shows a non-operative condition of the machine 10 in which all the mandrels 40—and, therefore, all the smoothing heads 50—are raised so that the abrasive tools 52 do not make contact with the material to be machined.

Figure 4:
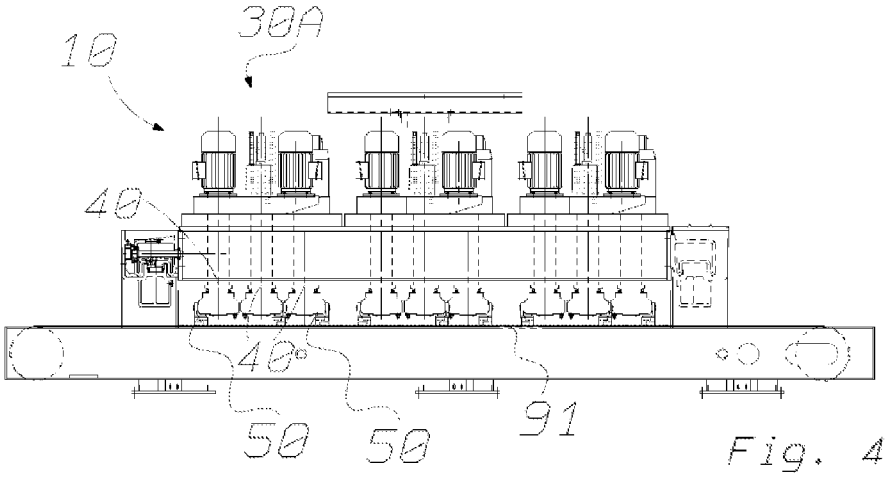
FIG. 4 shows a view, similar to that of FIG. 1, but with the mandrels in the lowered position.

FIG. 4, instead, shows the operating or working condition of the machine 10 in which all the mandrels 40 and therefore all the smoothing heads 50 are lowered and, consequently, the abrasive tools 52 make contact with the material to be machined, arranged on the surface 14.

As can be clearly seen in FIG. 7, each mandrel has a rotating shaft 92 provided with an axially sliding coupling having a kinematic transmission 93 connected to the respective motor 94. The shaft 92 is thus able to slide vertically upon operation of the cylinders 44. Advantageously two cylinders 44 are provided for each mandrel and are arranged symmetrically on both sides of the sliding shaft so as to balance the thrusting forces with respect to the mandrel axis.

A suitable rotating coupling 96 (not further shown or described, being known per se and therefore easily imagined by the person skilled in the art) is arranged on the central axis Z1 and allows electrical and fluid connection between the fixed structure of the machine and the mandrels 40, the motors 94, the pistons 44 and any further actuators and sensors arranged on the rotating structure 30.

Advantageously, the control unit of the machine, for example comprising a known microprocessor system which is suitably programmed, independently manages the vertical travel movement of single mandrels so that they rest at given points on the slab and all maintain a predefined machining pressure. Control of the machining pressure of the mandrels ensures optimum machining, despite the extension of the machining zone of each machining unit 30, and ensures a constant pressure over the entire zone for all the tools. As can be easily imagined by the person skilled in the art, the chosen pressure value will depend on the specific machining operation, the tool used and the material being machined.

It should be noted, therefore, that each abrasive tool 52, in relation to the material to be machined, performs a complex movement on the surface to be machined, composed of a plurality of individual movements and more particularly:

1. a rotational movement about the vertical axis of rotation $Z_2$ of the mandrel on which the smoothing head 50 is mounted;
2. a revolving movement about the vertical axis of rotation $Z_1$ of the mandrel carrying structures 30A,30B,30C;
3. a transverse, alternating, translation movement, in the direction Y, due to the movement of the mandrel carrying beam 24;
4. a longitudinal translation movement, indicated by F, due to feeding of the material placed on the belt; and
5. in the case of an oscillating-shoe smoothing head, such as that shown in FIGS. 1 to 7, an oscillating movement of the tool about the substantially horizontal rotational axis X of the shoe.

The composition of the movements and the individual speeds of rotation and translation may be easily managed by the control unit of the machine so as, for example, to maximize the machining uniformity without adversely affecting the speed of execution.

It has been found that advantageous speeds consist of those in the range, for example, of 10 to 60 rpm about the axes Z1 for the machining units and 300-600 rpm for the mandrels, and speeds of translation of between 0.5 and 4 m/minute for longitudinal displacement of the slab underneath the station, with a number of to-and-fro travel strokes for the transverse movement, for example ranging between 10 and 30 per minute. Obviously, the dimensions of the rotating units will depend on the particular machining needs, but a diameter of the mandrel carrying structures found to be particularly advantageous is that of around 1-1.5 meters with a diameter of the rotating tool supports equal to about 40-60 cm.

Depending on the specific requirements and the materials processed, the tools may also be different from those shown in FIGS. 1-7.

Figure 8:
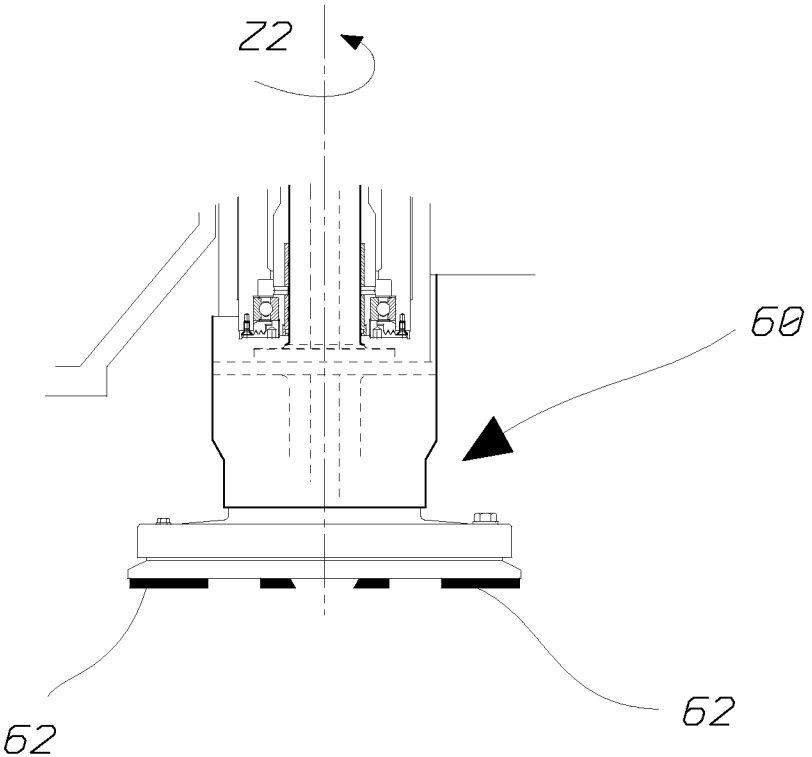
FIGS. 8, 9 and 10 are schematic and partial views of possible variants of the machine according to the invention.

For example, especially in the case of soft materials such as marble, the bottom end of the mandrels 40 may be simply fitted with an abrasive support plate 60 on which tools 62 with a flat support surface are mounted, as shown schematically in FIG. 8.

Figure 9:
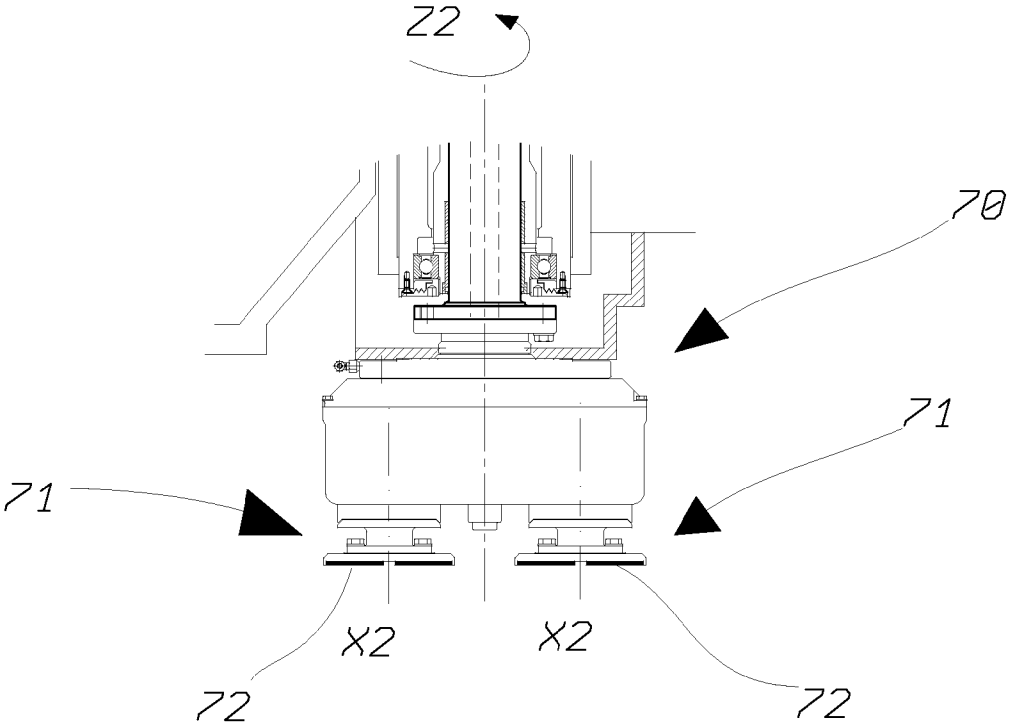

In the case of hard materials such as granite or quartz, instead of a smoothing head 50 with oscillating segments, it is also possible to mount on the bottom end of the mandrels 40 a flat-disc head 70 (also known as a planetary or orbital head), as schematically shown in FIG. 9, i.e. a head provided with rotating flat-disc holders or supports 71 with a substantially vertical axis X2 for flat abrasive tools 72. As is known, the axes X2 (generally arranged along a circumference around the main axis Z2 of the mandrel) may be rotationally driven by means of suitable mechanisms which are operated by rotation of the mandrel.

Figure 10:
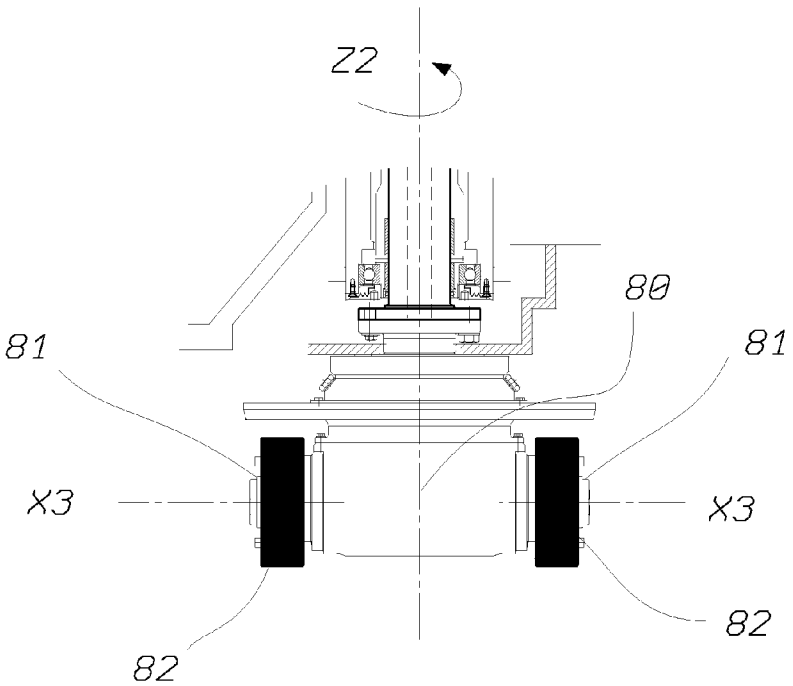

As shown in FIG. 10, another type of tool may comprise a roller smoothing head 80, i.e. a head fitted with radial rotating supports 81 with a substantially horizontal axis X3 on which roller-shaped tools 82 are mounted.

In the case of a flat-disc head, the movement of the tools indicated under point 5 consists of a rotation about the associated vertical axis, or, in the case of a roller head, it consists of a rotation about its horizontal axis.

In any case, the movement, thus composed, of a single abrasive tool allows the entire working surface of the slab to be covered in a uniform and regular manner.

Considering also the fact that the tools are multiple in nature (since there may be several mandrel carrying structures 30, each provided with several mandrels 40 and with each mandrel advantageously having several abrasive tools), it has been found that all the zones of the slab to be smoothed or polished are treated substantially to the same degree, namely there are no zones of the slab which are polished to a lesser degree and other zones which are polished to a greater degree since the stay time of the tools in the various zones of the slab is substantially the same. In this way, the degree of polishing is more or less constant and uniform over the entire width of the slab.

It should be noted, moreover, that the machining marks left by the abrasive tools are arranged in a random and disorderly manner owing to the particular complex imparted to them, with the result that they create a blurred effect such that the human eye is no longer able to distinguish said plurality of marks and therefore no longer perceives them as being such.

Basically, the slab appears to the human eye as being devoid of unevenly polished zones and machining marks, thereby resulting in a very high quality appearance, even in the worst conditions, namely in the case of dark coloured slabs viewed against the light.

It must also be remembered that the directions of rotation of the various smoothing and polishing heads 50 of each mandrel carrying structure 30 are preferably opposite to each other, and the adjacent mandrel carrying structures 30 also preferably have opposite directions of rotation and this further helps ensure that an optimum smoothing and polishing effect is achieved.

Figure 11:
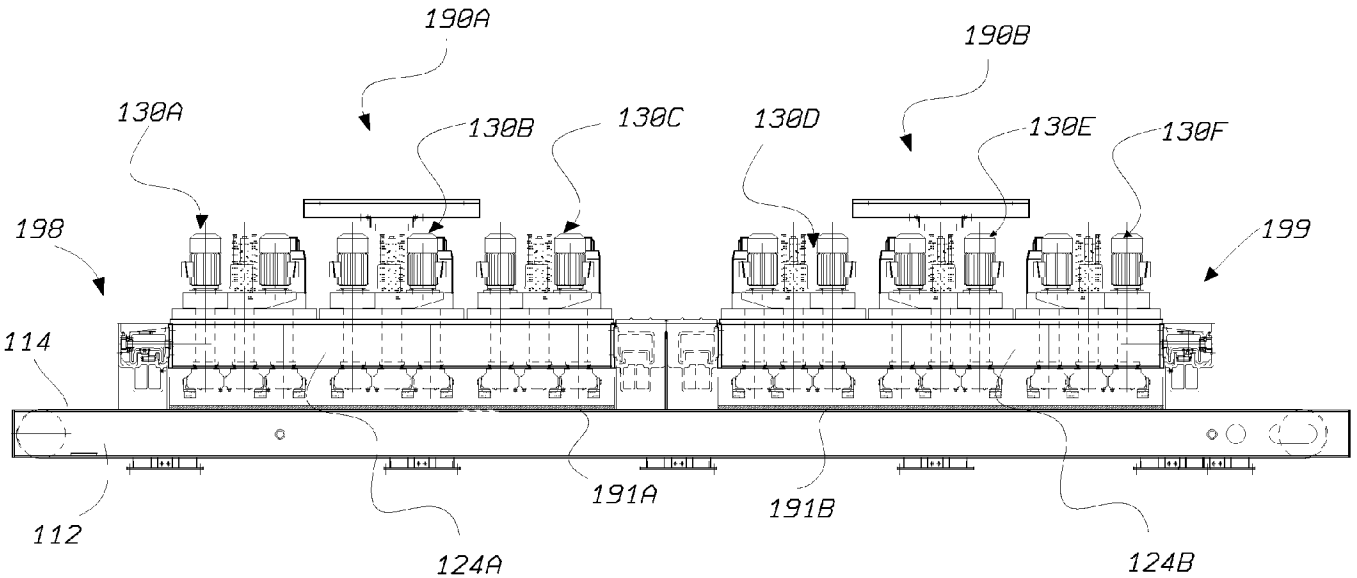
FIGS. 11 and 12 are, respectively, a front view and top plan view of a variant of a machine according to the invention.
Figure 12:
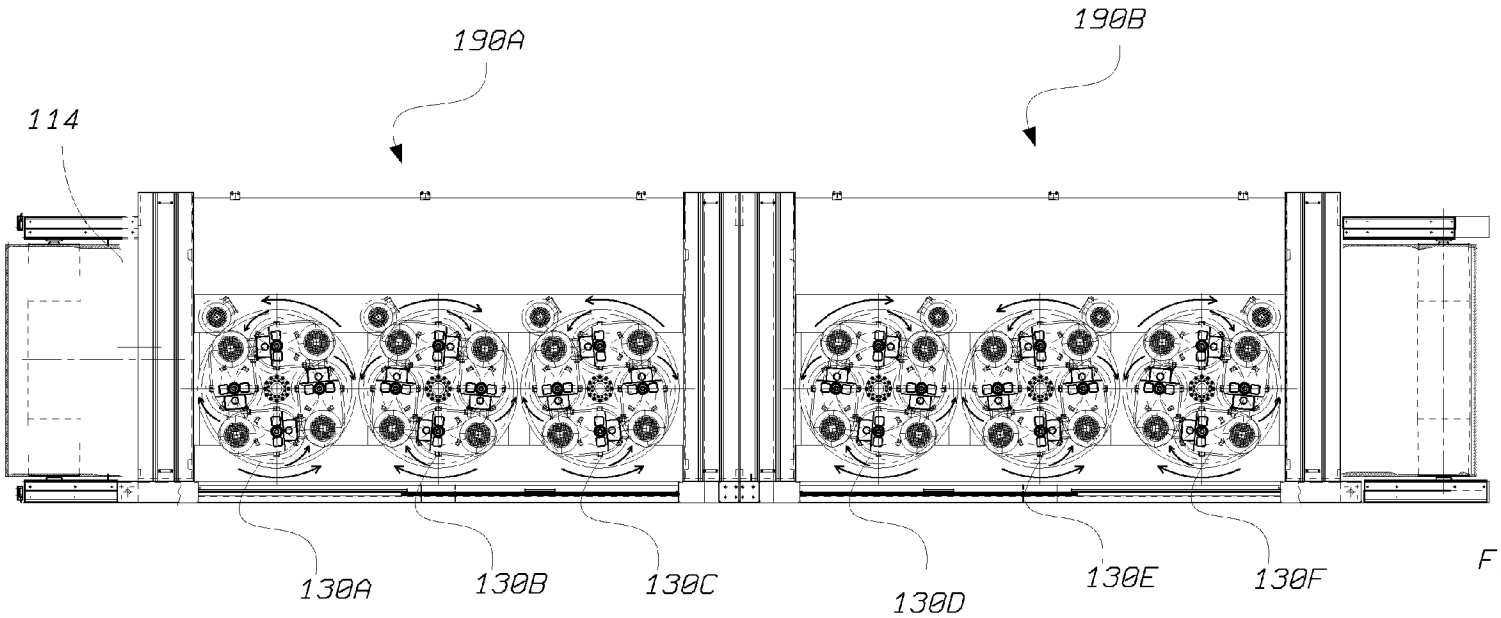

FIGS. 11 and 12 show a machine variant according to the invention, denoted generally by 100.

The machine 100 comprises essentially two stations 190A and 190B which are arranged in sequence along the conveyor belt 114. The two stations 190A, 190B, which are aligned in the direction of movement of the slab relative to the stations, are substantially the same as the station 90 of the machine 10 described above, so that parts which are similar to or the same as those already described with reference to the machine 10 are identified by the same reference numbers increased by 100.

The machine 100 therefore comprises two movable mandrel carrying beams 124A,124B on which three structures supporting the mandrels or machining units 130A,130B, 130C and 130D,130E,130F are mounted. The machining units will not be described here in detail since they are the same as those already described above for the machine 10.

A bench 112 with a conveyor belt 114, which receives on the entry side 198 the slabs to be machined and conveys them underneath the machining heads as far as the exit side 199, is provided underneath the stations.

Advantageously, all the smoothing heads of the same mandrel carrying structure are fitted with abrasive tools which have the same or similar grain size, but the tools which are mounted on the structures situated towards the exit side have a grain size which is finer that those mounted on the mandrel carrying structures situated towards the material entry side.

In this way, taking into account all that described above, it is possible to obtain slabs which are smoothed and polished to a very high finish.

The movements of the various parts of the stations 190A and 190B are similar to those already described above and the relative movements of the two stations may be synchronised or independent. The random addition of movements may also be advantageous so that the final polished appearance is even more uniform.

The tools which may be used may also be substantially the same as those already described and shown in the figures relating to the station 10.

At this point it is clear how the predefined objects are achieved, resulting in a machine able to produce rapidly a high-quality smoothing and/or polishing effect which appears, to the human eye, as being substantially defect-free.

Obviously, the above description of an embodiment applying the innovative principles of the present invention is provided by way of example of these innovative principles and must therefore not be regarded as limiting the scope of the rights claimed herein.

It is evident that variants and modifications which are functionally and conceptually equivalent fall within the scope of protection of the invention.

For example, the use of pneumatic actuators for the vertical movement of the mandrels advantageously results in easier adjustment and maintenance of the machining pressure. However, oil-hydraulic cylinders may be used instead of pneumatic cylinders for movement of the mandrels.

The mandrel carrying structures mounted on each beam may also consist of a number other than three, for example one, two, four or five.

Moreover, the mandrels for each mandrel carrying structure may consist of a number different from four, for example one, two or three mandrels. In the case of more than one mandrel it is preferable for the mandrels to be arranged circumferential equidistant around the axes of rotation of the associated machining unit. Several stations 90 or 190 may be arranged in the direction of longitudinal movement of the slabs. The system for conveying the slabs may also be different from a belt and/or comprise further loading and unloading devices, as can be easily imagined by the person skilled in the art.

The mandrels on each mandrel carrying support may also be arranged at a variable distance from each other and relative to the axis of rotation of the mandrel carrying support. The machine may also perform further machining operations, such as sizing of the slabs.

The invention claimed is:

1. Machine (10, 100) for smoothing or polishing slabs of stone material, such as natural and agglomerated stone, ceramic and glass, comprising a bench (12, 112) for supporting the slabs to be machined, there being provided above the bench at least one machining station (90, 190) comprising at least one pair of opposite bridge support structures (20, 22) transversally arranged astride the bench, means for relative movement in longitudinal direction between station and slab on the bench, at least one beam (24) the two ends (24*a*, 24*b*) of which are supported by said bridge support structures, at least one rotating mandrel (40) with a sliding vertical axis mounted on said at least one beam (24), at the bottom end of the mandrel there being provided at least one tool carrying support rotating about the axis of rotation (Z2) of said mandrel and carrying at least one abrasive tool (52, 62, 72, 82), characterized in that said at least one beam (24, 124) is transversally movable on said bridge structures (20, 22) so as to be moved alternately back and forth in the transverse direction; in that at least one mandrel carrying structure (30, 130), rotating about a vertical axis of rotation (Z1), is mounted on said beam; and in that said at least one vertically sliding mandrel (40) is mounted on said mandrel carrying structure (30, 130) in an eccentric position with respect to the axis of rotation (Z1) of said mandrel carrying structure, so that said tool carrying support performs at least a movement composed of the rotation about the axis of rotation of the mandrel, a revolving movement about the axis of rotation of the mandrel carrying structure and a translation movement due to the movement of the beam.

2. Smoothing or polishing machine according to claim 1, characterized in that the relative movement means comprise a belt (14, 114) travelling over the bench for moving the slabs under the station between an entrance side for slabs to be machined and an exit side for machined slabs.

3. Smoothing or polishing machine according to claim 1, characterized in that it comprises actuators (44) designed to push said mandrel and therefore said tool carrying support with an associated abrasive tool against the surface of the slab to be smoothed or polished.

4. Smoothing or polishing machine according to claim 1, characterized in that said mandrel carrying structure (30, 130) comprises at least two mandrels (40) eccentrically arranged with respect to the axis of rotation (Z1) of said mandrel carrying structure.

5. Smoothing or polishing machine according to claim 4, characterized in that said at least two mandrels (40) eccentrically arranged with respect to the axis of rotation (Z1) of said mandrel carrying structure are arranged circumferentially equidistant.

6. Smoothing or polishing machine according to claim 1, characterized in that it comprises at least two mandrel carrying structures (30, 130) and in that the grain size of the abrasive grains of the tools mounted on the mandrel carrying structure arranged on an entry side (98, 198) for the slab under the machining station is larger than the grain size of the abrasive grains of the tools mounted on the mandrel carrying structure arranged on an exit side (99, 199) for the machined slab.

7. Smoothing or polishing machine according to claim 1, characterized in that said tool carrying support consists of an abrasive carrying plate (60).

8. Smoothing or polishing machine according to any one of the preceding claims 1 to 6, characterized in that the tool carrying support consists of a head (50) comprising segments (51) each oscillating about a substantially horizontal axis (X) and radially arranged, said at least one abrasive tool (52) being mounted on each segment.

9. Smoothing or polishing machine according to claim 1, characterized in that the tool carrying support consists of a head (70) with flat discs comprising flat-disc carriers (71) rotating about respective substantially vertical circumferentially arranged axes (X2), an abrasive tool in the form of a flat disc (72) being mounted on each flat-disc carrier (71).

10. Smoothing or polishing machine according to claim 1, characterized in that the tool carrying support consists of a head (80) with rollers comprising supports (81) rotating about respective substantially horizontal radially arranged axes (X3), said at least one abrasive tool shaped as a roller (82) being mounted on each support (81).

11. Smoothing or polishing machine according to claim 3, characterized in that the actuators (44) are pneumatic.

12. Smoothing or polishing machine according to claim 3, characterized in that the pushing pressure of the mandrels (40) against the surface of the slab being machined on the bench is adjustable.

13. Smoothing or polishing machine according to claim 1, characterized in that mandrel carrying structures (30, 130) arranged alongside each other on the beam (24, 124) are motor-driven so as to rotate in opposite directions.

14. Smoothing or polishing machine according to claim 1, characterized in that several mandrels (40) arranged on the same mandrel carrying structure (30, 130) are arranged along a circumference, and each mandrel is motor-driven so as to rotate in the opposite direction with respect to an adjacent mandrel on the circumference.

15. Smoothing or polishing machine according to claim 1, characterized in that it comprises two stations (190A, 190B) arranged alongside each other in the longitudinal direction of movement of the slab with respect to the stations so as to machine the slab in sequence.

16. Smoothing or polishing machine according to claim 1, characterized in that said tool carrying support is capable of performing any of movements composed of the rotation about the axis of rotation of the mandrel, the revolving movement about the axis of rotation of the mandrel carrying structure and the translation movement due to the movement of the beam.

17. Smoothing or polishing machine according to claim 1, characterized in that said at least one mandrel is vertically slidable relative to the at least one mandrel carrying structure.

* * * * *